United States Patent [19]

Edminster

[11] Patent Number: 4,656,943

[45] Date of Patent: Apr. 14, 1987

[54] LOW PROFILE, PIVOTED GENERATOR

[75] Inventor: Robert E. Edminster, Scottsdale, Ariz.

[73] Assignee: Motorola, Inc., Schaumburg, Ill.

[21] Appl. No.: 679,657

[22] Filed: Dec. 7, 1984

[51] Int. Cl.[4] ..... F42C 11/00

[52] U.S. Cl. ..... 102/208

[58] Field of Search ..... 102/208

[56] References Cited

U.S. PATENT DOCUMENTS

| | | | |
|---|---|---|---|
| 3,757,695 | 9/1973 | Fisher | 102/208 |
| 3,861,312 | 1/1975 | Held et al. | 102/208 |
| 3,960,086 | 6/1976 | Fisher | 102/208 |
| 3,961,577 | 6/1976 | O'Steen | 102/208 |
| 3,990,370 | 11/1976 | Campagnuolo et al. | 102/208 |
| 4,027,593 | 6/1977 | Campagnuolo et al. | 102/208 |
| 4,031,827 | 6/1977 | Collier | 102/208 |

*Primary Examiner*—Charles T. Jordan

*Attorney, Agent, or Firm*—Lowell W. Gresham

[57] ABSTRACT

A low-profile generator contained within a housing and suitable for energizing electrical bomb fuzes is disclosed. A generating device attaches to an inside surface of a hinged cover. The cover pivots between a closed position where the generating device cannot engage a fluid flow and an open position where fluid flow causes a turbine to rotate and the generating device to produce electricity. Several safeguards are provided each of which tend to prohibit an unwanted opening of the cover.

17 Claims, 7 Drawing Figures

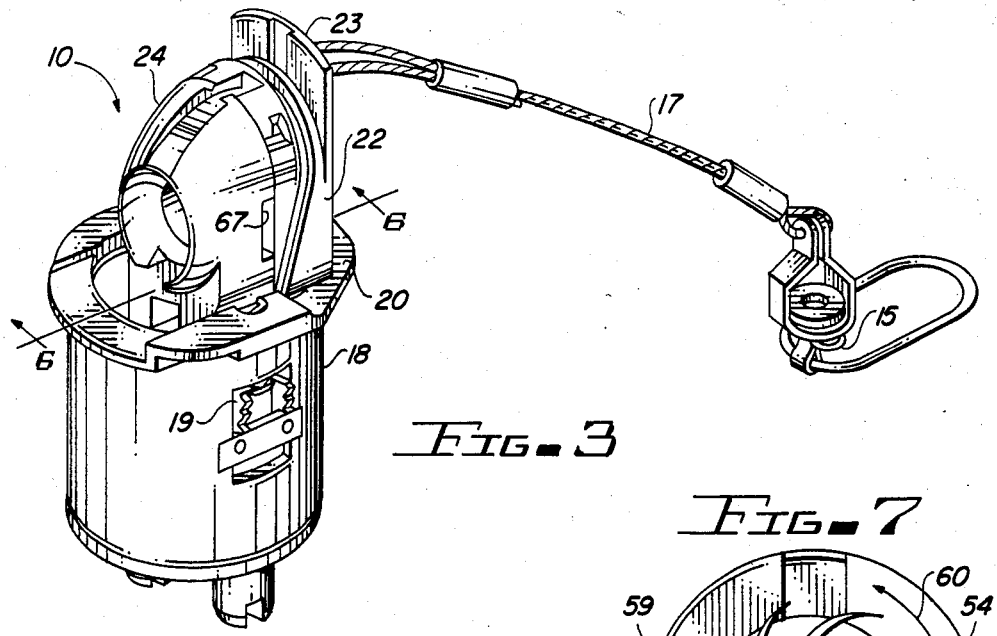
FIG. 3
FIG. 7
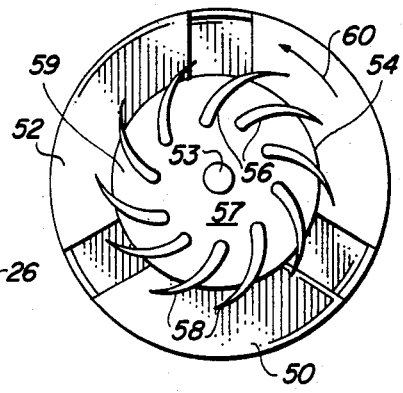
FIG. 6
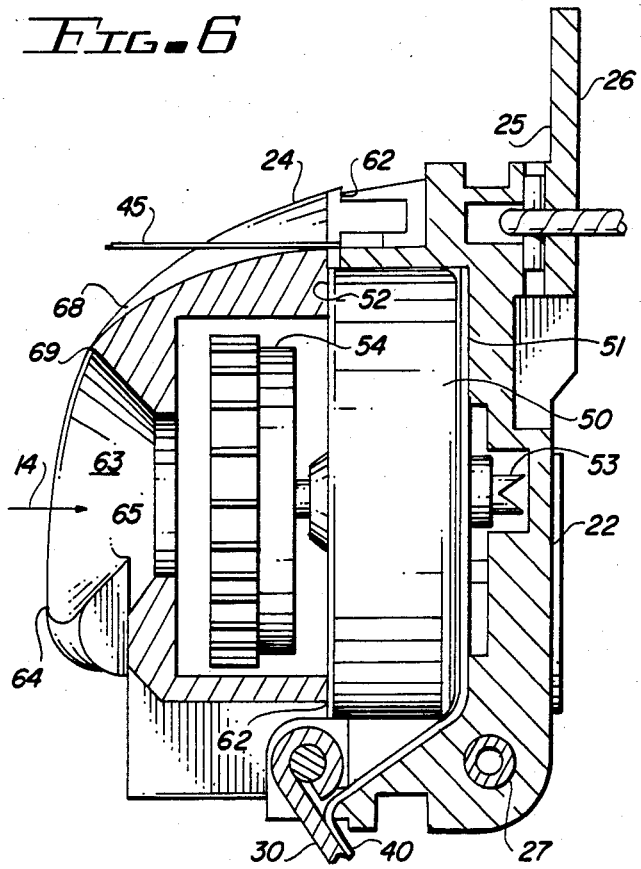

LOW PROFILE, PIVOTED GENERATOR

STATEMENT OF GOVERNMENT INTEREST

The invention described herein may be manufactured and used by or for the government for governmental purposes without the payment of any royalty thereon.

BACKGROUND OF THE INVENTION

This invention relates to devices which generate electricity from a fluid flow. Specifically the present invention relates to generators which are used in conjunction with electrical bomb fuzes. More specifically, the present invention concerns generators which are normally inoperative, but which may become operative upon the occurrence of specific events.

Fuzes permit explosive devices to detonate under certain conditions and prohibit detonation under all other conditions. Safety of those work with explosive devices is a key concern in fuze technology. Accordingly, many fuze designs go to great lengths to prohibit undesirable detonations of the explosive devices. Many fuzes are electrically energized. Thus, electrically energized fuzes prohibit detonation unless the fuze is energized.

Bombs are typically delivered to their intended targets by being launched through a fluid, such as air or water. When these bombs employ electrically energized fuzes, safety is enhanced by using a generator to electrically energize the fuze. Motion of the bomb through the fluid causes the generator to generate electricity, which in turn energizes the fuze. Accordingly, the bomb must be in motion before it can become armed.

Additional schemes insure that the bomb does not become undesirably armed even when it is in motion, such as when the bomb is being carried by an aircraft. One scheme utilizes a pop-up cover over a generator which is contained within an enclosure. The enclosure is designed to remain closed until the bomb is delivered to its target. As long as the enclosure remains closed, the fluid through which the bomb is moving cannot engage the generator, the generator cannot generate electricity, the fuze does not become energized, and the bomb cannot detonate.

Prior art devices provide various enclosure schemes. However, these devices suffer significant problems. These devices tend to exhibit a high profile in that they excessively protrude beyond the exterior surface of the bomb. This high profile causes problems concerning mounting the bomb to the aircraft or other vehicle. In some situations the bomb cannot be mounted. In other situations the bomb can be mounted, but the bomb's mounting lugs must be unscrewed so that the lugs extend sufficiently above the generator enclosure to allow attachment. However, when the bomb lugs have been unscrewed a dangerous situation exists because the bombs cannot be securely attached to the vehicle.

Another problem with the prior art devices relates to the generator efficiency. These devices typically deflect the fluid stream down into the enclosure where the fluid flow then engages a generator. Much of the fluid's energy is lost in the deflection. Thus, the prior art devices use relatively large and expensive generators to compensate for the relatively low energy fluid flow.

Yet another problem of the prior art concerns the reliability of opening the enclosure. If a sliding sleeve technique is used to open the enclosure, the sleeve is subject to binding and the enclosure reliably opens only if the opening force is exerted in precisely the proper direction. Thus, prior art devices often fail to open when they should open.

SUMMARY OF THE INVENTION

Accordingly, it is an object of the present invention to provide a pivoted generator.

Another object of the present invention relates to providng a generator which presents a low profile to the exterior surface of a mounting structure, such as a bomb.

Still another object of the present invention concerns providing a highly efficient generator which can employ a relatively small and inexpensive generating device.

The above and other objects and advantages of the present invention are carried out in one form by a cover which has an inward side and an outward side and is hinged to a structure so that the cover pivots between a closed position and an open position. A generating device attaches to the inward side of the cover. When the cover is in the closed position, the generating device is prevented from engaging a fluid stream. However, when the cover pivots to the open position, the generating device directly engages the fluid stream.

BRIEF DESCRIPTION OF THE DRAWINGS

A more complete understanding of the present invention may be derived by reference to the detailed description and claims when considered in connection with the accompanying drawings, wherein:

FIG. 3 shows an exterior view of the present invention in an open position;

FIG. 6 shows a cross-sectional view taken from line 6—6 in FIG. 3; and

FIG. 7 shows a generating device and turbine used in the present invention.

DETAILED DESCRIPTION OF THE PREFERRED EMBODIMENT

Figure 1:
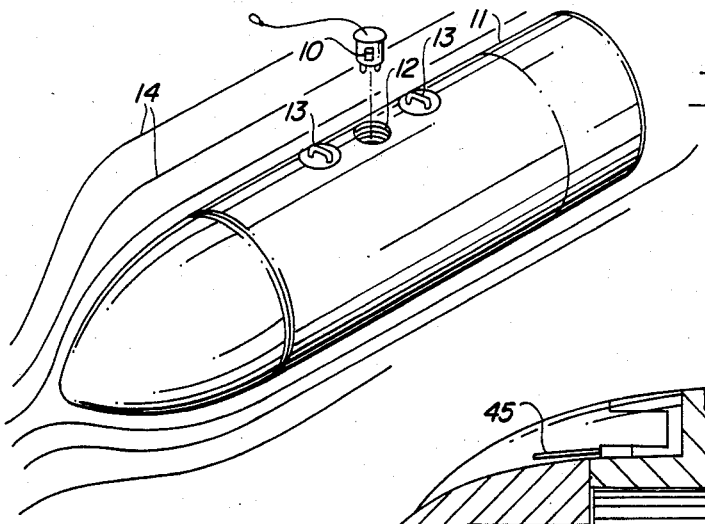
FIG. 1 shows the cooperation between a bomb, which may use the present invention, and the present invention.
Figure 2:
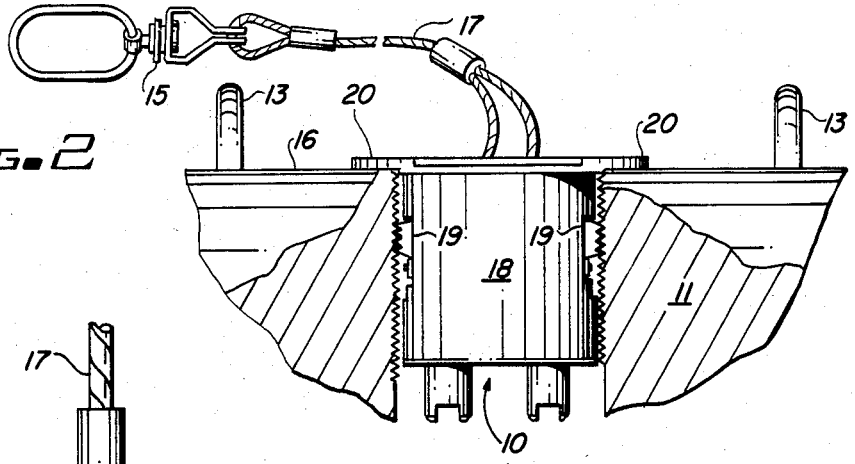
FIG. 2 shows a general outline of the present invention in a closed position and installed in a structure.

Referring to FIGS. 1–3, an apparatus 10 representing the present invention is shown relative to a structure 11, such as a bomb. Structure 11 contains a cavity 12 therein, such as a bomb's charging well. Apparatus 10 includes a cover 22 hinged to a housing 18. Except for a flange portion 20 of housing 18, cavity 12 holds housing 18 when apparatus 10 is installed in structure 11.

Housing 18 is securely fastened within cavity 12 through the use of any suitable fastener. Fasteners 19 shown in FIGS. 2 and 3 represent one suitable method for fastening housing 18 into cavity 12. Fasteners 19 are fully disclosed in co-pending application Ser. #656,800 entitled "Attachment Apparatus and Method for Attaching" filed by the present inventor on Oct. 1, 1984.

The present invention may be characterized by an open position as shown in FIG. 3 and a closed position as shown in FIGS. 1 and 2. It maintains a low profile because in the present embodiment, flange 20 represents the entire portion of apparatus 10 which protrudes outward from an external surface 16 of structure 11 when apparatus 10 is in the closed position. In this specific embodiment flange 20 is less than ¼ of an inch thick.

A lanyard 17 which connects to the outward side of cover 22 is used to pivot the cove between the clsoed and open positions. Structure 11 may attach to a vehicle (not shown) at attachement lugs 13. Likewise, apparatus 10 may attach to the vehicle at lanyard 17. The vehicle may release lugs 13 causing structure 11 to fal. As structure 11 falls, lanyard 17 applies an outward directed force to cover 22 causing cover 22 to pivot from the closed position to the open position. Thus, cover 22 tends to pivot in response to force applied through lanyard 17. As structure 11 continues to fall, a shear pin 15 breaks causing a remaining portion of lanyard 17 to separate from the vehicle. In the present invention cover 22 reliably opens when the outward force applied through lanyard 17 is exerted within 30 degrees of normal to extenal surface 16.

As structure 11 leaves the vehicle, it moves through a fluid, such as air or water. The movement through a fluid causes a fluid flow over exterior surface 16 of structure 11 as designated by flow lines 14 in FIG. 1. For example, a bomb released from an aircraft experiences free-fall which causes an air-flow over an external surface of the bomb. Fluid flow 14 exhibits a linear motion relative to structure 11. When apparatus 10 is in the closed positon as shown in FIGS. 1 and 2, an electricity generating device 50 (See FIGS. 6 and 7) attached to the inward side of cover 22 is prohibited from engaging fluid flow 14 and apparatus 10 is in an inoperative mode, or de-energized state, because it cannot generate electricity. However, when apparatus 10 is in the open position as shown in FIG. 3, generating device 50 directly engages fluid flow 14 and apparatus 10 is in an operative mode or energized state.

Additional precautions insure that cover 22 remains in the closed position in spite of unexpected events. Visor 23, which is an integral portion of cover 22, represents one such precaution. Visor 23 represents an extended portion of cover 22. Accordingly, when structure 11 attaches to the vehicle at lugs 13, the vehicle interferes with the opening of cover 22 because visor 23 contacts the vehicle if cover 22 attempts to open for an unexpected reason. In this event cover 22 may be positioned between the closed and open positions, but generating device 50 is still effectively precluded from engaging fluid flow 14.

Figure 5:
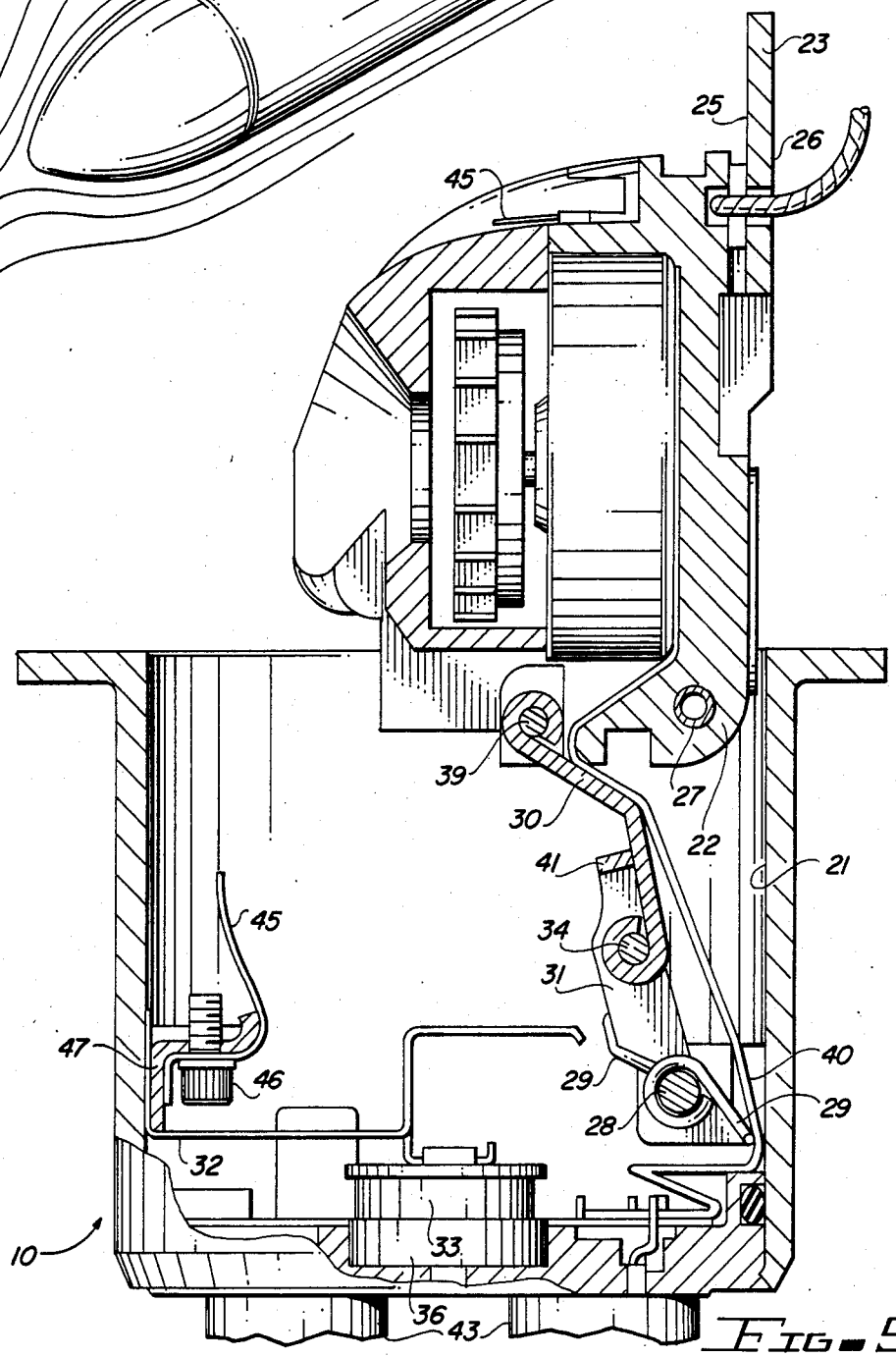
FIG. 5 shows a cross-sectional view of the present invention in the open position.
Figure 4:
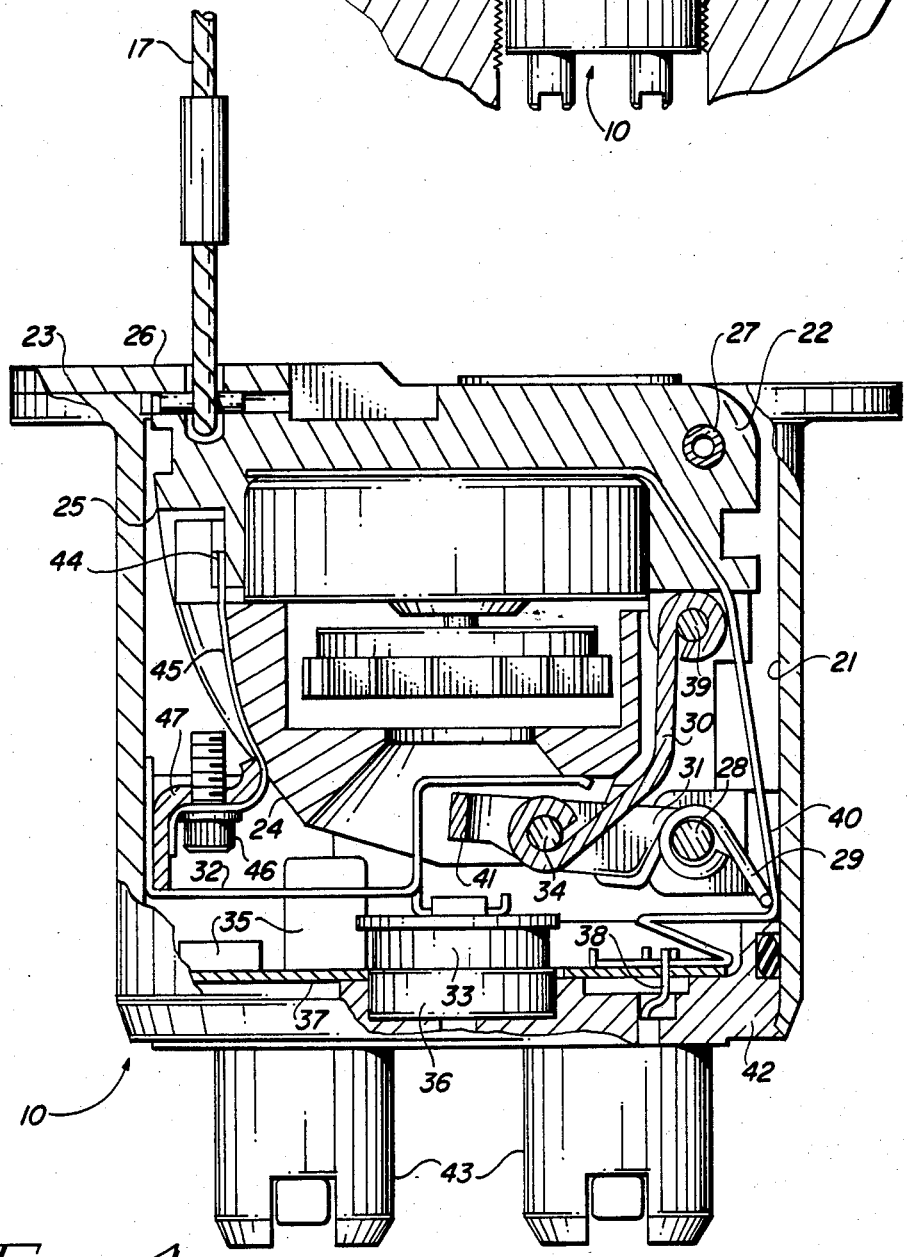
FIG. 4 shows a cross-sectional view of the present invention in the closed position.

Another precaution is provided by the linkage mechanism which connects cover 22 to the interior of housing 18. The linkage mechanism consists of a main link 30, a pivot link 31, and a double action linkage spring 29, as shown in FIGS. 4 and 5. Double action spring 29 couples between pivot link 31 and an interior wall 21 of housing 18. A first pivot point 28 of pivot link 31 connects to housing 18 through a suitable bracket (not shown). A second pivot point 34 connects pivot link 31 to main link 30. And, a third pivot point 39 connects main link 30 to cover 22.

When cover 22 is in the closed position, as shown in FIG. 4, double action spring 29 is biased so that it provides a force which resists the opening of cover 22. Regardless of other mechanisms which may prevent the opening of cover 22, lanyard 17 must rovide sufficient force to overcome the bias of spring 29 before cover 22 may open.

As lanyard 17 causes cover 22 to open, main link 30 and pivot link 31 both rotate around pivot points 28, 34 and 39. As cover 22 reaches a predetermined point between the closed and open position, spring 29 tends to provide a force which assists the opening of cover 22. In the present embodiment, this predetermined position is approximately 30% of the distance between the closed and open positions from the closed position. Cover 22 reaches the open position when main link stop 41, which represents one end of pivot link 31, abuts main link 30.

The process of opening cover 22 causes second pivot point 34 to move toward interior wall 21 of housing 18. When cover 22 is in the open position, second pivot point 34 is on the interior wall 21 side of an imaginary line (not shown) which extends between first pivot point 28 and third pivot point 39. This represents a past center alignment of second pivot point 34 which causes the linkage mechanism to lock cover 22 in the open position. Any attempt to close cover 22 would tend to cause second pivot point 34 to move toward interior wall 21. However, main link stop 41 prevents any further movement of second pivot point 34 toward interior wall 21 and cover 22 remains locked in place.

Another mechanism which prevents cover 22 from opening is breakable link 45. A bracket 47 connects to an interior wall of housing 18. A screw 46, or othe suitable attachment means, securely fastens breakable link 45 to bracket 47. Breakable link 45 also securely fastens to cover 22 at end 44. Thus, before cove 22 may open, breakable link 45 must break. In this specific embodiment, a link which breaks with the application of approximately 60 lbs. of force is used for breakable link 45.

To summarize the closed and open positions, when cover 22 is in the closed position generating device 50 is prohibited form engaging fluid flow 14. Before cover 22 may open, structure 11 must be released from the vehicle so that the vehicle does not interfere with visor 23. The force supplied outwardly through lanyard 17 must be sufficient to overcome the bias of spring 29, and the force applied through lanyard 17 must also be great enough to break breakable link 45. The opening of cove 22 causes generating device 50 to pivot outward and directly engage fluid flow 14 without deflecting fluid flow 14 into the interior of housing 18.

FIGS. 4 and 5 show an end cap 42 which removably attaches to housing 18 distally from cover 22. End cap 42 contains connectors 43 and electrical circuit board 37. Connector pins 38 electrically couple signals from circuit board 37 to connectors 43.

Electrical components 35, which are mounted on circuit board 37, provide an electrical interface between generating device 50 and connectors 43. A conventional voltage regulation circuit as known to those skilled in the art may be implemented using components 35.

A timing circuit represents another function which may be implemented using components 35. The present invention incorporates a timing circuit which is energized by a power source made from a magnet 36 and a metallic slug 33 rather than from generating device 50. When cover 22 is in the closed position, metallic slug 33 is adjacent magnet 36. No electricity is generated because magnetic flux couples through metallic slug 33.

A slapper spring 32 attaches at a first end thereof to the interior of housing 18 at bracket 47. A central portion of slapper spring 32 connects to metallic slug 33, and a second ed of slapper spring 32 is positioned between pivot link 31 and cover 22. As cover 22 opens, main link stop 41 contacts slapper spring 32 and then bends slapper spring 32 toward cover 22 causing metalic slug 33 to separate from magnet 36. At this point, components 35 encounter a magnetic flux from magnet 36, and slapper spring 32 is biased so that a force is imparted to metallic slug 33 which would tend to cause metallic slug 33 to move toward magnet 36. However, main link stop 41 prevents metallic slug 33 from so moving.

As cover 22 continues to open, main link stop 41 slides along slapper spring 32 until it reaches the second end of slapper spring 32. When main link stop 41 no longer contacts slapper spring 32, slapper spring 32 causes metallic slug 33 to slap or contact magnet 36 and break the magnetic flux in electrical components 35. This break in magnetic flux causes the generation of an instantaneous electrical pulse which is stored for a predetermined amount of time in electrical components 35 using conventional techniques, such as capacitors. Other devices electrically coupled to apparatus 10 through connectors 43 may use this stored electrical pulse in conjunction with electricity generated by generating device 50 to indicate the recent opening of cover 22.

As can be seen in FIGS. 4, 5, and 6, an electrical coupling 40 such as a flexible circuit or cable, connects circuit board 37 generator 50.

FIG. 6 shows the cooperation between cover 22, generating device 50, a turbine 54, and a shroud 24. Cover 22 contains an inward side 25 and an outward side 26. Generating device 50 has a mounting side 51 and a flow-engaging side 52. Mounting side 51 of generating device 50 faces inward side 25 of cover 22. Generating device 50 includes a rotor 53, which has a turbine 54 attached thereto. Shroud 24 has a flow engaging side 69, an interior side 62, a venturi 63, and a surface 68. Shroud 24 mounts to cover 22 and generating device 50 so that interior side 62 faces inward side 25 of cover 22. A hinge 27 is used to connect cover 22 to housing 18 so that cover 22 may pivot between the closed position and the open position.

Shroud surface 68 is steamlined so that a combination of cover 22 and shroud 24 present only a minimum amount of drag to fluid flow 14 and so that cover 22 may freely pivot between the closed and opened positions without binding against the interior of housing 18.

Apparatus 10 engages fluid flow 14 at shroud venturi 63. Venturi 63 represents a chamber through shroud 24 which tapers from a relatively large opening 64 to a relatively small opening 65. As is well-known in the art, fluid flow 14 tends to increase in speed after passing through a venturi, such as venturi 63.

After fluid flow 14 passes through venturi 63 it engages turbine 54 at a turbine central area 57 (see FIG. 7). Turbine 54 contains a plurality of turbine blades 56 normally attached to a turbine base 59. Each of turbine blades 56 are slightly curved so that as flow 14 moves past turbine blades 56, turbine 54 tends to rotate. FIG. 7 shows turbine blades 56 curved so that turbine 54 rotates in a counterclockwise 60 direction. After fluid flow 14 leaves turbine 54, it passes out from shroud 24 at exhaust vents 67 (see FIG. 3).

The rotation of turbine 54, which is attached to rotor 53, causes generating device 50 to produce electricity as is well-known to those skilled in the art. Of course those skilled in the art will recognize that generating device 50 represents common generators, alternators, and other devices which translate rotary motion into electrical energy.

The present invention incorporates a governor which controls the amount of electricity producible by generating device 50. In the present embodiment the governor is implemented in two ways. First, exhaust vents 67 are limited to a predetermined size. Accordingly, exhaust vents 67 limit the amount of fluid which passes through turbine 54 and therefore limit the rotational speed of turbine 54 and the amount of electricity generated. Second, tips 58 of turbine blades 56 extend beyond turbine base 59 and are constructed from a flexible material. As turbine 54 rotates faster, turbine blade tips 58 tend to flex outward due to fluid pressure and centrifugal force. When turbine blade tips 58 flex outward, the amount of curvature in the blades decreases and this decrease tends to slow the rotational speed of turbine 54 and the amount of electricity generated. Those skilled in the art will recognize that other techniques for regulating the amount of electricity produced by the present invention are also possible.

The foregoing description uses a specific embodiment to illustrate the present invention. However, those skilled in the art will recognize that changes and modifications may be made in this embodiment without departing from the scope of the present invention. Such changes and modifications are intended to be included in this invention.

What is claimed is:

1. An apparatus for generating electricity from a fluid flow, the apparatus having operative and inoperative modes, the apparatus comprising:

a cover having inward and outward sides, said cover being hinged to a structure so that said cove pivots between a closed positon where the apparatus is in the inoperative mode and an open position; and an electricity generating device having a mounting side and a flow engaging side, the mounting side of said generating device attached to the inward side of said cover so that said cover being in the closed position substantially prevents the flow-engaging side of said generating device from engaging the fluid flow, and said cover being in the open position allows the flow-engaging side to engage the fluid flow.

2. An apparatus as claimed in claim 1 wherein said generating device comprises:

a rotor; and a turbine coupled to said rotor on the streamengaging side of said generating device, said turbine being for translating flow of the fluid into rotary motion of the rotor.

3. An apparatus as claimed in claim 1 additionally comprising a generator shroud positioned on the flow-engaging side of said generating device, said shroud being for streamlining said generating device.

4. An apparatus as claimed in claim 3 wherein said generator shroud includes:

a flow-engaging side and an interior side;

a venturi therein tapered from a relatively larger opening at the flow-engaging side of said generator shroud toward a relatively smaller opening at the interior side; and an exhaust vent on the interior side.

5. An apparatus as claimed in claim 3 wherein said generator shroud additionally comprises a governor for regulating the amount of electricity producible by the apparatus.

6. An apparatus as claimed in claim 1 wherein the structure has a cavity therein and said apparatus additionally comprises a housing connected to said cover and to the structure so that said cover pivotally connects to said housing, and said housing is securely fastened within the structure cavity.

7. An apparatus as claimed in claim 6 wherein said housing contains an electrical circuit, said circuit being electrically coupled to said generating device.

8. An apparatus as claimed in claim 6 wherein the structure has an exterior surface and said housing includes a flange that protrudes outward from said exterior surface less than approximately one-fourth of an inch.

9. An apparatus as claimed in claim 1 additionally comprising a linkage mechanism coupled between said cover and the structure so that said cover is spring biased to remain the closed position.

10. An apparatus as claimed in claim 1 additionally comprising a lanyard connected to the outward side of said cover for application of a force to said cover which tends to cause said cover to pivot to the open position.

11. An apparatus as claimed in claim 1 additionally comprising a linkage mechanism coupled between said cover and the structure so that said linkage mechanism is spring biased to assist the opening of said cover after the cover pivots a predetermined distance between the closed and open positions.

12. An apparatus as claimed in claim 1 additionally comprising a linkage mechanism coupled between said cover and the structure so that once said cove is in the open position, said cover becomes locked in the open position.

13. A method of energizing a bomb fuze from a fluid flow comprising the steps of:

attaching a generating device to a cove which pivotally couples to an exterior surface of a bomb;

maintaining a de-energized state so long as the cover is pivoted so that the generating device is substantially prevented from engaging the fluid flow; and pemitting an energized state when the cover pivots so that the generating device engages the fluid flow.

14. A method as claimed in claim 13 additionally comprising the step of channeling fluid flow to the generating device through a generator shroud having a venturi opening therein.

15. A method as claimed in claim 13 additionally comprising the step of controlling the generating device so that an electrical output from the generating device is limited to a predetermined amount.

16. A method as claimed in claim 13 additionally comprising the steps of:

installing an electronic circuit in a housing; and electrically coupling the electronic circuit to the generating device.

17. An apparatus for converting air-flow over an exterior surface of a bomb in free-fall into electricity, the bomb having a charging well and the apparatus having energized and de-energized states, the apparatus comprising:

a housing securely fastened within the charging well of the bomb;

a cover having inward and outward sides, said cover being hinged to said housing so that said cover pivots between a closed position where the apparatus is in the deenergized state and protudes beyond the exterior surface of the bomb less than approximately one-fourth of an inch, and an open position;

an electricity generating device having a mounting side and a flow-engaging side, the mounting side of said generating device attached to the inward side of said cover so that when said cover is in the closed position the flow-engaging side of said generating device is substantially prevented from engaging the air-flow, and when said cover is in the open position the flow-engaging side engages the air-flow;

an electrical circuit located in said housing and electrically coupled to said generating device;

a generator shroud positioned on the flow-engaging side of said generating device, said shroud having a flow-engaging side, an interior side, a venturi therein tapered from a relatively larger opening at the flow-engaging side of said shroud toward a relatively smaller opening at the interior side, and an exhaust opening on the interior side;

a governor for regulating the amount of electricity producible by the apparatus;

a linkage mechanism coupled between said cover and the housing so that said cover is spring biased to remain in the closed position, so that siad cover is spring biased to pivot to the open position without the application of external force after the cover pivots a predetermined distance between the closed and open positions, and so that once said cover is in the open position said cover becomes locked in the open position; and a lanyard connected to the outward side of said cover for application of a force to said cover which tends to cause said cover to pivot to the open position.

* * * * *

UNITED STATES PATENT AND TRADEMARK OFFICE

CERTIFICATE OF CORRECTION

PATENT NO. : 4,656,943

DATED : April 14, 1987

INVENTOR(S) : Robert E. Edminster

It is certified that error appears in the above-identified patent and that said Letters Patent is hereby corrected as shown below:

Column 7, line 18, between words "remain" and "the", insert --in--;
Column 7, line 31, change "cove" to --cover--;
Column 7, line 36, change "cove" to --cover--; and
Column 8, line 40, change "siad" to --said--.

Signed and Sealed this

Twenty-second Day of September, 1987

*Attest:*

DONALD J. QUIGG

*Attesting Officer* *Commissioner of Patents and Trademarks*